US006782841B2

(12) United States Patent
Esposito

(10) Patent No.: US 6,782,841 B2
(45) Date of Patent: Aug. 31, 2004

(54) BOAT WITH CONVERTIBLE TENDER GARAGE AREA

(75) Inventor: Joe Esposito, Dix Hills, NY (US)

(73) Assignee: Seavanna, LLC, Dix Hills, NY (US)

( * ) Notice: Subject to any disclaimer, the term of this patent is extended or adjusted under 35 U.S.C. 154(b) by 0 days.

(21) Appl. No.: 10/219,199

(22) Filed: Aug. 15, 2002

(65) Prior Publication Data

US 2004/0031432 A1 Feb. 19, 2004

(51) Int. Cl.[7] ..... B63B 23/28
(52) U.S. Cl. ..... 114/366; 114/189; 114/259
(58) Field of Search ..... 114/258, 259, 114/71, 365, 366, 188, 189, 248, 192, 193, 363, 375; 296/24.1, 190.2; 105/314, 315, 316, 317, 321

(56) References Cited

U.S. PATENT DOCUMENTS

| | | | | | |
|---|---|---|---|---|---|
| 1,123,068 | A | * | 12/1914 | Barney | 114/78 |
| 2,472,185 | A | * | 6/1949 | Apel | 114/363 |
| 2,590,045 | A | * | 3/1952 | Schiff | 105/315 |
| 2,743,683 | A | * | 5/1956 | Calhoun | 105/315 |
| 3,347,201 | A | * | 10/1967 | Szabo | 114/248 |
| 3,475,773 | A | * | 11/1969 | Codman, Jr. | 114/361 |
| 3,567,272 | A | * | 3/1971 | Low | 296/156 |
| 3,634,897 | A | * | 1/1972 | Cuccio | 114/343 |
| 3,815,541 | A | * | 6/1974 | Hansen | 114/248 |
| 3,874,009 | A | * | 4/1975 | Nosaka et al. | 5/9.1 |
| 4,503,799 | A | | 3/1985 | Masters | |
| 4,550,946 | A | * | 11/1985 | Hanemaayer | 296/156 |
| 4,567,845 | A | * | 2/1986 | Smith | 114/363 |
| 4,729,334 | A | * | 3/1988 | DeJean, Jr. | 114/255 |
| 4,854,261 | A | * | 8/1989 | Goldsmith | 114/363 |
| 5,031,563 | A | * | 7/1991 | Matre | 114/188 |
| 5,136,963 | A | * | 8/1992 | Zuzik | 114/363 |
| 5,195,445 | A | | 3/1993 | Riddles et al. | |
| 5,331,917 | A | * | 7/1994 | Magers | 114/361 |
| 5,615,633 | A | | 4/1997 | Cripe | |
| 5,904,113 | A | | 5/1999 | Slikkers | |
| 6,016,636 | A | * | 1/2000 | Caputo | 52/745.2 |
| 6,263,825 | B1 | | 7/2001 | Davidson | |
| 6,283,059 | B1 | * | 9/2001 | Scully, Jr. | 114/363 |
| 2002/0038623 | A1 | * | 4/2002 | Irish | 114/259 |

OTHER PUBLICATIONS

"75' Motor Yacht Accomodation Plans", Viking Sport Cruisers, Copyright 2000. http://www.vikingsportcruisers.com/75my/75myplans.asp.*

* cited by examiner

*Primary Examiner*—Andrew Wright
(74) *Attorney, Agent, or Firm*—Dilworth & Barrese LLP

(57) ABSTRACT

A boat has a system for converting a utility space used for garaging a dinghy and formed under the cockpit of the boat into an additional living cabin when the dinghy is removed from the garage.

19 Claims, 4 Drawing Sheets

BOAT WITH CONVERTIBLE TENDER GARAGE AREA

BACKGROUND OF THE INVENTION

1. Filed of the Invention

The invention relates to a structure of cruising boats and motor yachts. Particularly, the invention relates to a motor yacht arrangement directed to the efficient use of living and tender storage space and a system for providing such an arrangement.

2. Background of the Related Art

Aesthetics, comfort and cost are three principles every boat designer must deal with while constructing a cruising boat. Often, these principles collide with one another, and a relatively fast and inexpensive boat may suffer from lack of comfort and space Alternatively, a comfortable boat can be prohibitively expensive. Achieving an acceptable compromise without significantly sacrificing any of the above-stated principles is a haunting task causing boat designers to look for new materials, and to use the latest achievements in electronics, mechanics and boat construction.

In boat construction and design, the problems encountered are both functional and aesthetical. Creating a true motor yacht requires the melding of art and science—a skillful blend of the craftsman's artistry with the best boat building technologies available. Particularly, the efficient use of the boat space offers a unique challenge for a boat designer. An optimal boat design is a function of multiple components; however, the starting point is always related to the dimensions of the boat to be designed. What can be easily accomplished on a larger watercraft cannot be incorporated in a design of a smaller boat without bold engineering innovations. Sometimes miniscule improvements of a standard boat design can lead to enormous advantages, such as enhanced living conditions and an increase in comfort of crewmembers and passengers Accordingly, the marketability of the improved watercraft can be favorably affected as well.

For instance, motorboats, cruisers and motor yachts, usually more than 30 feet long, commonly carry smaller boats or dinghies used for a variety of purposes, such as local trips when a watercraft is at port. Many designs of cruisers, boats and motor yachts have long incorporated swim or sports platforms mounted to the stern of the boat's hull and used in association with a variety of sports activities, such as diving, waterskiing and the like. However, in view of the dramatic increase in the popularity of personal watercraft, the swim platform is also often being used as a storage site for dinghies. Accordingly, storing a dinghy on the swim platform, which is sometimes called a sports platform, defeats all other purposes for which this platform can be effectively used.

More sophisticated boat designs feature a tender garage sized to receive the entire length of the dinghy. Considering that motor yachts of this kind have capacity for cruises with long stops at ports, the dinghy can be extensively used for local trips. However, the use of the garage space for dinghy, which is often large, in addition to its direct purpose, is typically limited to storing purposes. Accordingly, when the dinghy is in use, a large space that could be effectively used for additional purposes, such as temporary living quarters, remains unexploited.

Still other designs directed to a boat structure having the dinghy stored on a deck. These designs are associated with a mechanism, such as a crane, operative to lift the dinghy onto the deck from the water. Such a design may have a few disadvantages. First, the crane is costly. Second, this mechanism is a highly visible structure occupying a relatively large area and diminishing an aesthetical appeal of the boat. Third, high visibility of the dinghy may negatively affect the aesthetics of the boat as well. Finally, a deck, particularly the one adjacent the flybridge, like a swim or sports platform, may be used for other purposes, such as sunbathing Storing the dinghy on the deck precludes the crew and passengers from using the deck for these purposes.

It is, therefore, desirable to provide a boat structure having a balance of style, utility and comfort. Also a structural boat arrangement including a singular space suitable for use as a utility space and as a living quarter is desirable as well, as is a system for providing such an arrangement.

SUMMARY OF THE INVENTION

Consistent with the foregoing needs and requirements, this invention relates to a boat structure with a unique arrangement of singular boat space that can be efficiently and alternatively used as a garage and as a living quarter. In particular, in accordance with the invention, the boat structure has a singular space, which is both uniquely convenient for displacement of the dinghy from and into this space and, when the dinghy is not garaged, useful as a comfortable living quarter or cabin. The living cabin is spacious and equipped with all necessary amenities that provide the cabin's occupants with a comfortable lifestyle.

In accordance with another aspect of the invention, the motor yacht has a system operable for converting the singular space adapted to store the dinghy and extending between the boat's floor and the bottom of the cockpit into the living cabin having a size which is unprecedented for a 50-70 fly-bridge foot motor boat.

The inventive design has numerous advantages. The main advantage, obviously, is that the motor yacht is provided with an additional living space when the dinghy is out A further advantage stems from the fact that the cabin's occupants have all necessary amenities and, in addition, a direct access to the swim platform which can be used for various recreational purposes. Accordingly, the cabin provides an interior environment where—depending on the weather—the occupants can socialize, comfortably rest and enjoy the unique location of the cabin next to the water. Thus, the inventive arrangement provides the motor yacht with an elegant, functional, and mature structure.

A further aspect of the invention includes a drain system, which allows for watering and, thus, for cleaning of the garage space. The drain system is constructed to prevent water from penetrating into the foot and storage space of the living cabin located immediately below the garage space.

Yet a further inventive aspect of the invention is directed to a molded unit mounted under the cockpit and having two compartments, one of which defines the footspace of the convertible living cabin. The other compartment defines a space designed to be used as a stateroom. The molded unit, as a whole, is formed so that it conforms to the floorplan of the boat defined by longitudinal and cross reinforcing beams. In particular, the structure of the molded unit has locations arranged in each of the compartments and designed to accommodate toilets, sinks, drains and other amenities, which are all located in sunken areas between the beams. As a result, all of the components installed on the molded unit do not add to the overall height of the boat which is, thus, designed to have a cockpit area positioned relatively low with respect to the waterline, a feature which contributes to the elegant boat line.

BRIEF DESCRIPTION OF THE DRAWINGS

The above and other features, objects and advantages will become more readily apparent from the description of the preferred embodiment accompanied by the flowing drawing, in which.

DESCRIPTION OF THE PREFERRED EMBODIMENT

A boat designed in accordance with the invention has a unique structural arrangement for a singular space provided in the aft area between the lowest floor of the boat and the underside of the cockpit. The inventive structural arrangement allows the singular space to be selectively used as a dinghy garage/utility space and as a living quarter provided with the necessary amenities.

Referring to FIGS. 1–8 in general, a motorboat or motor yacht embodying the teachings of the present invention is generally designated as 10. The boat may be formed of any suitable material such as aluminum or fiberglass. Although certain aspects of the present invention can be indiscriminately applied to any type of a watercraft, the present design is particularly advantageous fir the fly-bridge type of cruisers having a length not exceeding about 70 feet.

Figure 1:
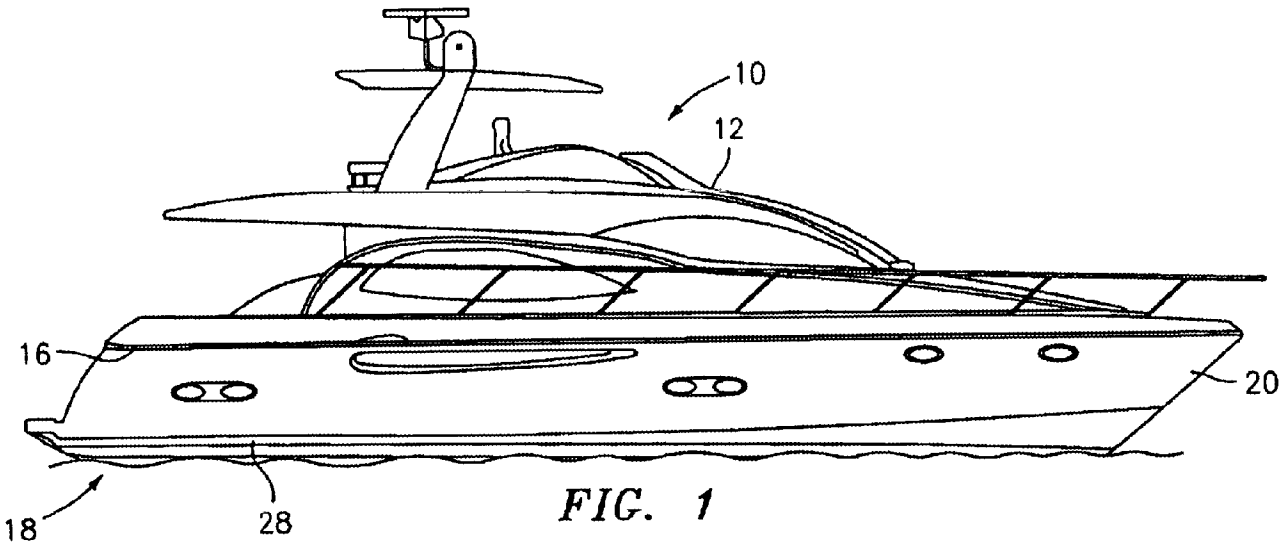
FIG. 1 is a side elevational view of a boat according to the invention.
Figure 2:
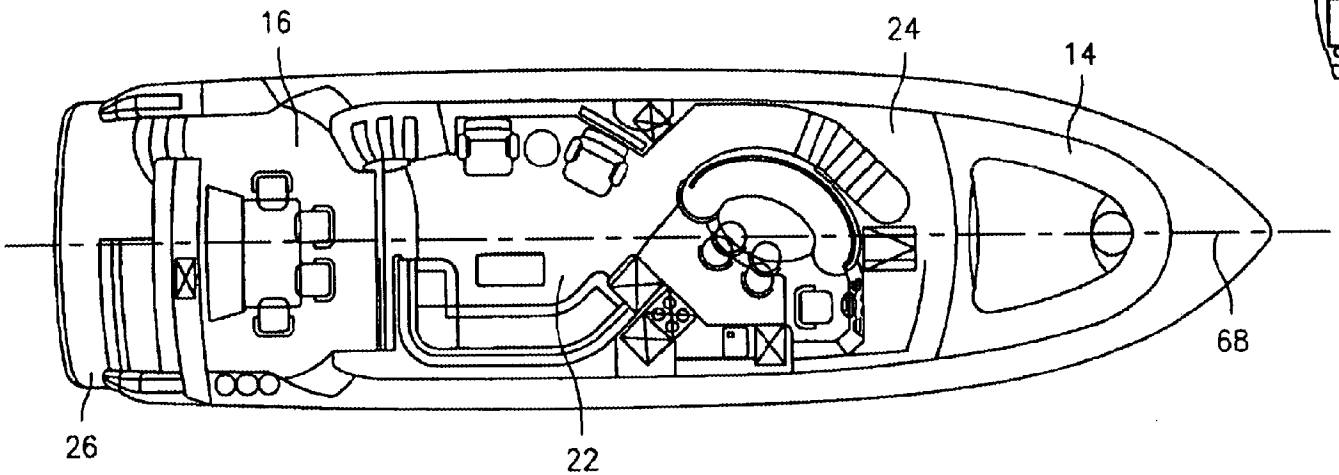
FIG. 2 is a top view of the boat of FIG. 1, which is fragmentally sectioned to illustrate master and VIP staterooms.

As shown in FIGS. 1 and 2, the boat 10 includes three main areas, a fly-bridge area 12 located between a raised forward deck 14, which is associated with the bow part 20 of the hull, and a cockpit 16 at the aft 18 of the hull. One of the luxurious features of the boat 10 includes two spacious staterooms, a master stateroom 22 located under the fly bridge and a VIP stateroom 24 located adjacent to the master stateroom and extending toward the raised forward deck 14. The cockpit 16 has, for example, an array of cushions one of which can flip to provide access into an aft space between the bottom of the cockpit and a floor 28 of the boat 10.

In accordance with the main concept of the invention directed to the efficient use of the boat space, the singular aft space is arranged to be alternatively used as a garage 34 for a dinghy 36 (FIGS. 4–5) or as a living cabin, which is provided with a combination of the amenities including a toilet 54, a sink 52, a shower space 84, and at least one berth 96 (FIG. 6) Location of the aft space is critical for both garaging and living purposes and occupies a space defined, in a longitudinal direction, between a swim platform and a kitchen and, in a vertical direction, between the floor 28 of the boat and the bottom of the cockpit 16. When used as the living cabin, it can provide at least two people with a comfortable lifestyle upon temporary removal of the dinghy 36. Thus, in accordance with one embodiment of the invention, the aft space is automatically converted into the living cabin provided with the amenities by simply displacing the dinghy outside.

Figure 4:
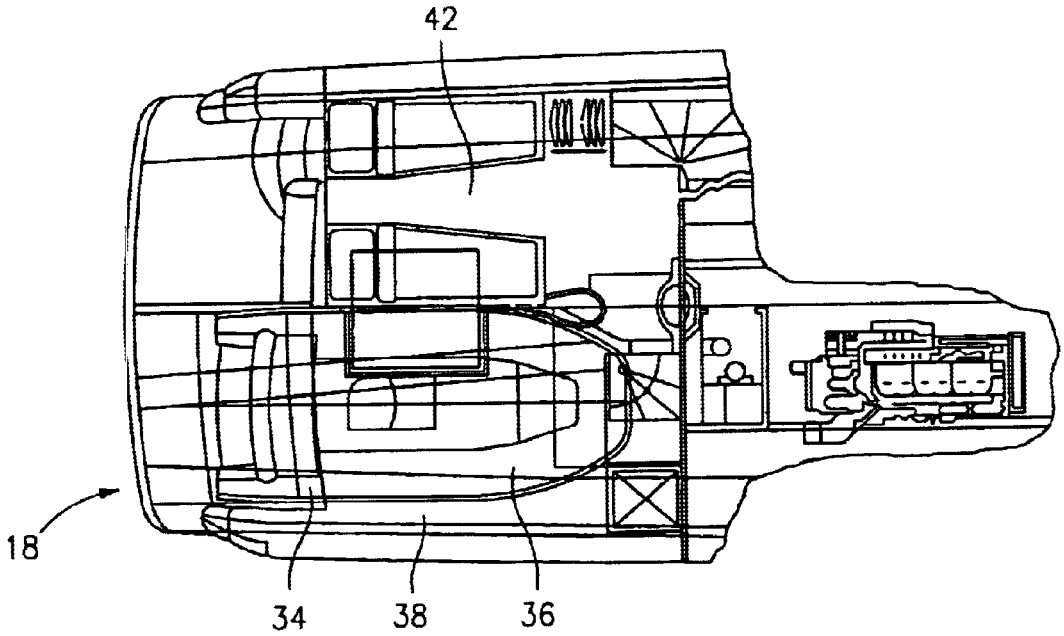
FIG. 4 is a plan, top view of the aft area provided with a garage space for dinghy associated with the boat of FIG. 1.
Figure 5:
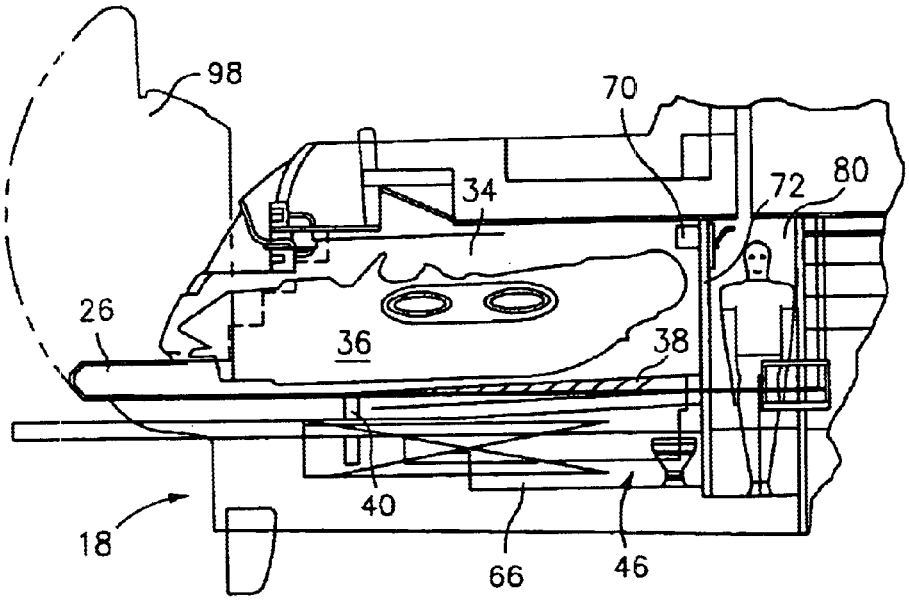
FIG. 5 is an elevational side view of the aft area in accordance with FIG. 4.
Figure 6:
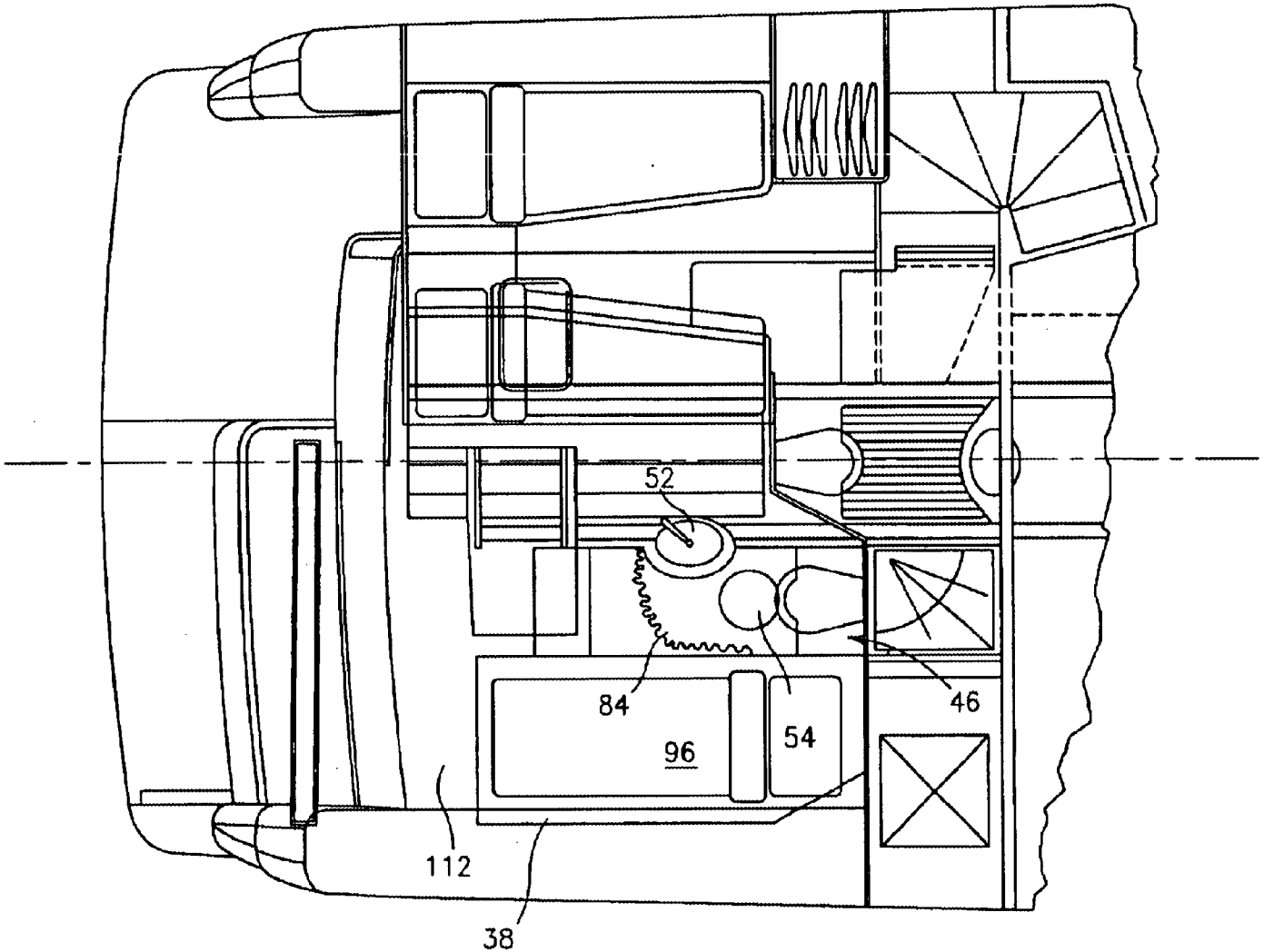
FIG. 6 is a plan, top view of the aft area with an additional living cabin of the boat illustrated in FIG. 1 after the dinghy has been removed from the garage space.

According to another embodiment, the aft space is provided with an assembly for converting this space from the garage into the living cabin. In particular, as shown in FIGS. 4–6, the aft space has a relatively small stateroom 42 and a utility compartment. In accordance with this embodiment of the present invention, the utility compartment has the assembly for using the utility compartment in two different modes. In one of the modes, part of the volume of the utility compartment defines the garage 34 (FIGS. 4–5) for the dinghy 36, whereas the other part is a foot space, and in the other mode, the entire space volume is used as the living cabin 46 (FIG. 6).

An assembly for converting the garage 34 into the additional living cabin 46 and vice versa includes a simple panel or hatch 38 pivotable between a closed (FIGS. 4, 5 and 8) and open position (FIG. 6). In the closed position, the hatch 38 functions as the floor for the garage 34 and, thus, divides the storage space into the foot space 66 (FIGS. 5 and 8) and the garage 34, whereas, upon rotating the hatch at a 180° angle to the open position (FIG. 7), the entire storage space converts into the living cabin 46.

The hatch 38 extends from a swim platform 26 (FIGS. 1 and 5) and covers the entire length of the utility compartment dimensioned so that when the dinghy 36 is entirely housed in the garage 34, its longitudinal axis extends parallel to a longitudinal axis 68 of the boat 10 (FIG. 2). Location of the garage 34 is particularly convenient for pulling the dinghy in and out because the hatch 38 terminates next to the swim platform 26 that, in turn, is located next to the water line. A mooring tool 70 (FIG. 5) can include any suitable motorized means mounted, for example, on a partition 72 (FIG. 5), which defines the front wall of the utility compartment. Since the garage 34 extends in a longitudinal direction, pulling the dinghy into the garage includes a simple operation of attaching the bow of the dinghy to a cable and actuating the mooring tool.

Figure 8:
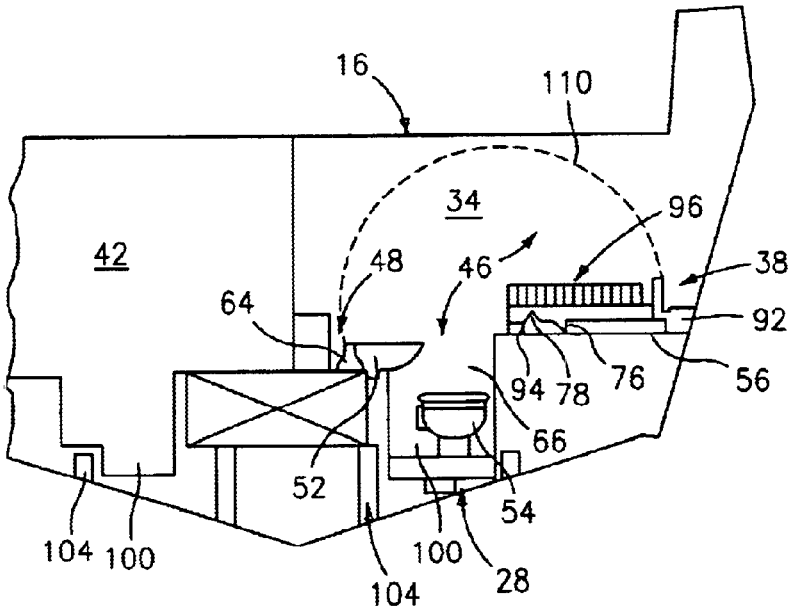
FIG. 8 is a sectional rear view of the aft area showing a system for converting the utility space into the living space in accordance with the invention.

Turning to FIG. 8, the hatch 38 has a longitudinal guide rail 76 provided with a groove 78, which is shaped and dimensioned to receive a means for rolling or sliding the dinghy in and out. Accordingly, the longitudinal guide rail 76 provides an easy, smooth and unidirectional guidance of the dinghy. Preferably, the groove 78 has a V shape.

Figure 7:
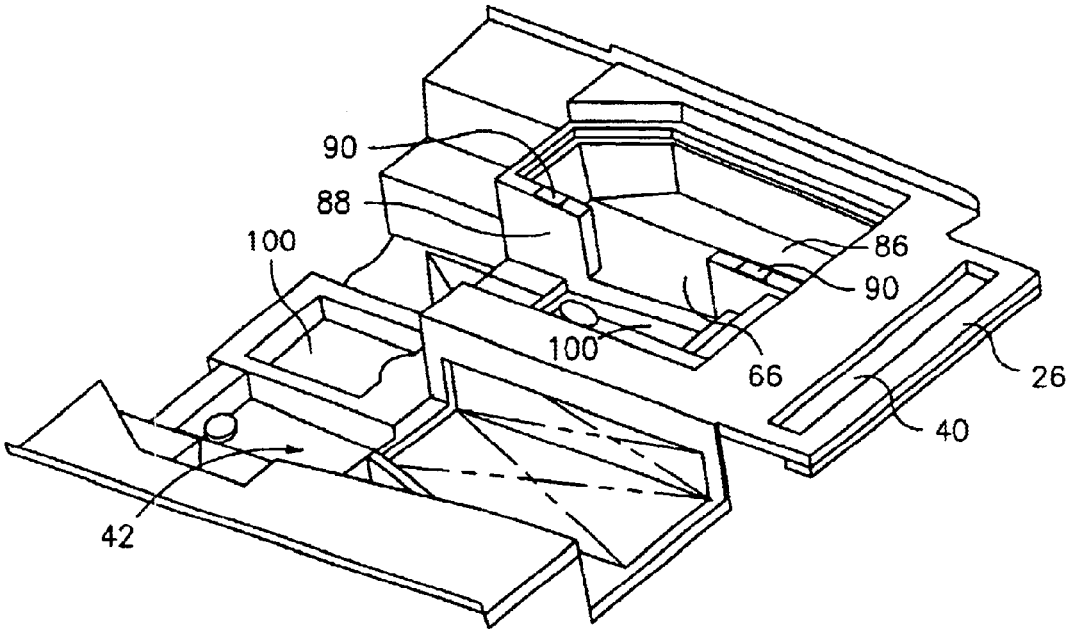
FIG. 7 is an isometric view of a molding unit including a stateroom space and the floor space for the additional living cabin, as shown in FIG. 7.

It is essential that water entering the garage 34, as the dinghy 36 is being pulled in, be quickly drained to prevent flooding of the foot space 66. Furthermore, when the dinghy is removed from the garage 34, it is desirable to clean the hatch 38, which also necessitates the installation of a drain assembly. These requirements are met by a drainage system including a main drain outlet 40, which, as shown in FIGS. 5 and 7, is formed in the swim platform 26 Another drainage unit 64, as illustrated in FIG. 8, is located next to the outer longitudinal edge 48 of the hatch 38 and is in flow communication with the drain outlet 40 for evacuating water, which, for example, can be accumulated during washing the garage 34, away from the latter. In addition, the inner side of the hatch is layered with waterproof material 56 protecting the foot space 66 from residual water drops.

FIG. 7 illustrates a molded unit mounted under the cockpit 16 between the opposite longitudinal sides of the boat and essentially including two compartments. One of the compartments defines the smaller stateroom 42 typically used by crew and including two berths, a toilet and a shower 80, as better illustrated in FIG. 5. The other compartment defines the foot space 66 located adjacent to the stateroom 42 and, as shown in FIG. 6, including a combination of the sink 52, the toilet 54, and the curtain-defined shower 84.

The molded unit can be used with the first embodiment of the invention, wherein the garage and living cabin are arranged within a singular space convertible by virtue of displacing the dinghy in and out of the space, and with the other embodiment of the invention featuring the assembly for converting the utility compartment into the living cabin by means of the hatch 38. Although the molded unit, as shown in FIG. 8, is associated with the embodiment provided with the hatch 38, simple structural changes directed to rearrange the toilet, sink, drain and shower to provide a space sufficient to accommodate the dinghy can be made by an ordinary skilled boat designer.

Figure 3:
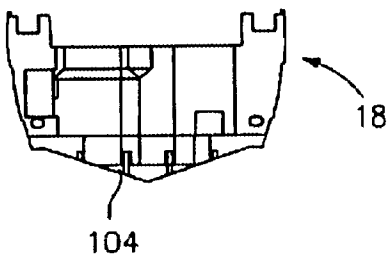
FIG. 3 is a rear elevational view of the hull of the boat shown in FIG. 1.

The molded unit is structured to have its contour conforming to the geometry of the floor 28 of the boat 10 which, as explained below, contributes to the overall aesthetics of the inventive boat. As shown in FIGS. 3 and 8, the boat 10 is provided with a plurality of longitudinal beams 104 and cross beams, not shown in the drawing. It is generally accepted that the cockpit positioned relatively low with respect to the water line provides a motor yacht with the improved aesthetics. By molding the unit so that all toilets, sinks, berths and the like are located only within sunken areas 100 (FIG. 8) defined between the longitudinal and cross reinforcing beams contributes to the overall relatively small vertical dimension of the aft area. Thus, in accordance with the invention, not only the aft area is formed with the additional living cabin in which people can stand upright, but also this area is so dimensioned that a distance between handrails 104 (FIG. 3) installed on the cockpit 16 and the waterline does not exceed two (2) meters, creating an elegant boat line.

Returning to FIG. 7, the foot space 66 is accessible when the garage 34 is converted into the living cabin 46 by pivoting the hatch 38 along a curved path 110, as illustrated in dash lines in FIG. 8. The floor of the compartment 66 may be slightly inclined to provide automatic evacuation of water, when, for example, the shower 84 is being used. In addition, the floor of the foot space 66 has a recessed partition 88 defining a storage space 86, which is covered by a top cover 92 (FIG. 8) sealingly protecting the storage space 86 from dripping water when the hatch 38 is displaced in its open position, in which it lies atop the cover 92. Thus, the cover 92 provides a hatch support and has a recess 94 receiving the guide rail 76 in the open position of the hatch 38, as shown in FIG. 8. The recessed partition 88 has its top provided with a pair of hinges 90 supporting the hatch 38 and defining an axis of rotation about which the hatch pivots along the curved path 110 between the open and closed positions.

As shown in FIGS. 6 and 8, the inner side of the hatch 38 facing the foot space 66 is provided with a mattress or berth 96, which, when displaced with the hatch in the open position of the latter, can be easily accessed by a person, as better seen in FIG. 6. The living cabin 46 is so spacious that it can easily accommodate an additional berth 112, as better seen in FIG. 6

The dimensions of the living cabin 46 allows for a tall person to stand upright, without touching the bottom of the cockpit. Therefore, as the storage space is converted into the living cabin, the occupants can relax there with comfort. In addition, as illustrated in FIG. 5, the aft area includes a garage door 98 mounted on the deck in a swinging or sliding manner between a closed position completely blocking access to the garage or living cabin and an open position. Accordingly, the swingable door 98 provides direct communication between the interior of the living cabin 46 and the outside and, thus, adds additional comfort for the cabin's occupants Further, the living cabin has a direct access to the cockpit upon flipping one of the cushions located in the cockpit 16.

While the invention has been disclosed with respect to preferred embodiments, various changes can be made without departing from the scope of the invention as defined by the appending claims.

What is claimed is:

1. A boat structure comprising:

a cockpit;

a floor spaced from the cockpit, the floor and the cockpit defining a space therebetween in an aft end of the boat structure, the space being openable to an outside of the boat structure; and a divider displaceable within the space between a closed position and an open position, in the closed position the divider extending between and spaced from the cockpit and the floor so that the space is divided into an upper volume configured to garage a dinghy and a lower volume, the divider supporting a dinghy while the dinghy is displaceable through the aft end of the boat structure from the outside thereof into the upper volume of the space and conversely, and in the open position the divider being positioned so that the space is undivided and configured to be a living cabin.

2. The boat structure according to claim 1, wherein the lower volume is provided with a sink, a toilet, a berth, and a drain.

3. The boat structure according to claim 1, wherein an outer side of the divider facing away from the floor in the closed position of the divider has a longitudinal groove, the longitudinal groove being dimensioned to guide the dinghy between the outside of the boat structure and the upper volume.

4. The boat structure according to claim 3, further comprising a rolling or sliding assembly displaceable along the longitudinal groove formed in the outer side of the divider, the rolling assembly being configured to carry the dinghy between the outside of the boat structure and the upper volume.

5. The boat according to claim 3, wherein an inner side of the divider, which is opposite to the outer side thereof, is provided with a bed accessible in the open position of the divider.

6. The boat according to claim 5, wherein the inner side of the divider is provided with a layer of waterproof material preventing water from penetrating the lower volume in the closed position of the divider.

7. The boat structure according to claim 1, wherein the space has a front wall spaced frontward from the aft end and provided with a winch mounted thereon for displacing the dinghy along the divider into the upper volume from the outside of the boat structure.

8. The boat according to claim 7, further comprising a door spaced rearwards from the front wall and swingable between a first and second position, wherein in the first position, the door preventing access to the space from the outside of the boat structure and defining a rear wall of the upper volume, and in the second position, the door providing access between the outside of the boat structure and the upper volume.

9. A boat comprising:

a hull provided with a lower floor and extending along a longitudinal axis;

a cockpit floor arranged in an aft area of the boat and spaced upwards from the lower floor of the hull to define a singular space therebetween;

an arrangement including a toilet, a sink, a drain, and a berth provided in the singular space;

a divider displaceable within the singular space between the lower and cockpit floors and pivotal about a pivot axis, which extends parallel to the longitudinal axis, between an open position, in which the singular space is undivided and used as a living cabin, and a closed position, in which the divider extends across and divides the singular space into an upper garage space and a lower foot space, the upper garage space being dimensioned and shaped to receive a dinghy, the divider having an inner side facing the lower foot space in the closed position of the divider and provided with a layer of waterproof material, the layer of waterproof material being sandwiched between and coupled to a bed and to the inner side of the divider so that the bed is displaceable with the divider and accessible in the open position of the divider.

10. The boat according to claim 9, further comprising:

a molded unit extending between opposite longitudinal sides of the boat and defining a stateroom extending laterally from the lower foot space, the lower foot space being provided with a sloped floor to drain water and with a partition extending from the lower floor upwards and defining a storage compartment in the lower foot space, the partition having a top side terminating at a distance from the cockpit floor and hingedly supporting the divider.

11. The boat according to claim 10, wherein the divider extends above and across the entire lower foot space toward and terminates substantially next to the stateroom in the closed position thereof, the divider extending over and covering the storage compartment in the open position thereof.

12. The boat according to claim 10, wherein the stateroom has a plurality of additional berths, a second toilet, a second sink and a shower.

13. The boat according to claim 10, wherein the lower foot space is provided with a seating area accessible by people from the cockpit in the open position of the divider, the singular space being dimensioned so as to allow a person to stand upright in the open position of the divider.

14. The boat according to claim 10, wherein the singular space is provided with a front wall extending between the lower and cockpit floors, the boat further comprising a winch mounted on the front wall in the singular space for displacing the dinghy into the upper garage space, the molded unit having a swim platform spaced rearwards from the front wall and extending outwards from the lower foot space substantially at a water level, the swim platform being provided with a draining opening preventing water from entering into the singular space upon displacing the dinghy into the upper garage space.

15. The boat according to claim 14, wherein an outer side of the divider, facing away from the lower foot space in the closed position of the divider, has a guide rail provided with a longitudinal groove, which is dimensioned to guide a rolling or sliding assembly carrying the dinghy into and out of the upper garage space along a ramp provided in the swim platform.

16. The boat according to claim 15, further comprising a cover configured to support the divider in the open position thereof and provided with a trough shaped and dimensioned to receive the guide rail.

17. The boat according claim 16, wherein the cover is made from waterproof material.

18. The boat according to claim 14, further comprising a door spaced rearwards from the front wall and swingable about a door axis extending perpendicular to the longitudinal axis between a closed position, wherein the door prevents access to the singular space from the swim platform and defines a rear wall of the upper garage space, and an open position, wherein the door provides access thereto.

19. A boat having a cockpit floor spaced above a water line and a lower deck floor spaced downwards from the water line so that the lower deck floor and the cockpit floor define a space therebetween in an aft end of the boat opening to an exterior of the boat, the boat comprising a divider reciprocally displaceable within the space between a first and second position, in the first position, the space is being undivided and configured to be a living cabin, and in a second position, the space being divided into an upper subspace and a lower subspace, the upper subspace being dimensioned to selectively retain equipment, the divider being adapted to guide said equipment from the exterior of the boat into the upper subspace and conversely.

* * * * *